US005125757A

United States Patent [19]

Morrison et al.

[11] Patent Number: 5,125,757

[45] Date of Patent: Jun. 30, 1992

[54] LOTION DISPENSER APPLICATOR

[75] Inventors: Jim A. Morrison, Valrico; Manuel A. Vazquez; Anthony D. King, both of Tampa, all of Fla.

[73] Assignee: Clasique Products International, Inc., Tampa, Fla.

[21] Appl. No.: 629,254

[22] Filed: Dec. 17, 1990

[51] Int. Cl.[5] ..... A61H 15/02

[52] U.S. Cl. ..... 401/21; 401/23; 401/28; 401/195; 401/202; 401/214; 128/57

[58] Field of Search ..... 401/21, 28, 23, 195, 401/196, 202, 209, 213, 220; 128/24.3, 57, 67

[56] References Cited

U.S. PATENT DOCUMENTS

| | | | |
|---|---|---|---|
| 1,405,059 | 1/1922 | Morgan | 401/21 |
| 2,116,864 | 5/1938 | Fehrenbach | 401/28 X |
| 3,752,155 | 8/1973 | Blinoff, Jr. et al. | 126/24.3 |
| 4,427,001 | 1/1984 | Kiefer et al. | 128/57 X |
| 4,483,356 | 11/1984 | Kales | 401/126 X |

FOREIGN PATENT DOCUMENTS

| | | | |
|---|---|---|---|
| 168576 | 6/1951 | Austria | 128/57 |
| 1286023 | 1/1962 | France | 128/57 |
| 641656 | 3/1984 | Switzerland | 401/28 |
| 196951 | 4/1923 | United Kingdom | 401/28 |
| 2176114 | 12/1986 | United Kingdom | 128/57 |

*Primary Examiner*—Danton D. DeMille

*Attorney, Agent, or Firm*—Dominik, Stein, Saccocio, Reese, Colitz & VanDerWall

[57] ABSTRACT

A dispenser-applicator comprising a ball applicator assembly, oppositely-faced sponge applicator assembly, and a reservoir for storage of a topical preparation formed therebetween. The reservoir functions to supply the topical preparation to the ball applicator assembly to be dispensed onto a person's skin, whereupon the sponge applicator may then be used to more evenly spread the topical preparation over the person's skin. An elongated handle is connected to the ball applicator assembly to facilitate filling of the reservoir with the topical preparation and to further facilitate use of the applicator in applying the topical preparation to the person's skin.

2 Claims, 4 Drawing Sheets

LOTION DISPENSER APPLICATOR

BACKGROUND OF THE INVENTION

1. Field of the Invention

This invention relates generally to dispenser-applicators for dispensing and then applying a liquid to the skin of animals. More particularly, this invention relates to dispenser-applicators for dispensing and then applying sun tan lotion, sunscreens or other liquid topical preparations to a person's skin.

2. Description of the Background Art

Frequently, it is desired or necessary that liquid substances be applied topically to a person's skin. For example, as often encountered in geographical areas where ultraviolet rays from the sun are plentiful, it is desired, and often medically-recommended that persons exposed to such ultraviolet rays for extended periods of time, protect their skin with suntan lotions or oils, sunscreen products, or medically-prescribed or recommended topical medicinal preparations. However, the application of such topical preparations to one's skin is often a cumbersome task. For example, the application of a topical preparation to one's back section, or other difficult-to-reach anatomical parts, usually necessitates the assistance of others. Further, the dispensation and application of such topical preparations usually requires applying them first to one's hands, then using the hands to apply the preparations to the remainder of the anatomy. This procedure is undesirable due to the mess created by having oily and wet preparations on one's hands.

Lotion applicators have been developed for the application of lotions and other topical skin preparations to various portions of the human anatomy. Some of the prior art applicators use a rolling ball and others use a sponge. However, the applicators of the prior art have failed to provide dual contact applicator surfaces: a massaging ball applicator surface and an oppositely-faced sponge surface applicator, both within the same dispenser-applicator unit. For example, patents which disclose sponge or pad applicators include U.S. Pat. Nos. 2,800,673 to Lazisky; 2,995,768 to Skuratowicz; 4,381,766 to Avolio; 4,483,356 to Kales; 4,483,636 to Meyer; 4,869,612 to Mooney et al.; 4,883,380 to Ritterman; 4,886,388 to Gulker; and, 4,906,118 to Crooks. None of the above sponge or pad type applicators cited above provide or mention a dual applicator surface comprising a ball applicator and a sponge applicator, with a reservoir for storage of topical preparation therebetween.

Ball-type applicators have been described in U.S. Pat. Nos. 1,089,683 to Stapler; 4,571,106 to Scuderi; 4,037,977 to Ronai; 4,326,508 to Stauffer; 4,492,223 to Burke; and 4,823,777 to Goncalves et al. None of the above roller ball-type applicators provide to mention a dual applicator surface comprising a ball applicator and a sponge applicator, with a reservoir for storage of topical preparation therebetween.

Therefore, it is an object of this invention to provide an apparatus which overcomes the aforementioned inadequacies of the prior art devices and provides an improvement which is a significant contribution to the advancement of the lotion applicator art.

Another object of this invention is to provide an improved preparation dispenser-applicator which would allow the user to dispense and apply a topical preparation to various difficult-to-reach parts of the human anatomy without the assistance of others.

Another object of this invention is to provide an improved dispenser-applicator which substantially avoids the mess associated with the application of suntan lotion and oil preparations.

Another object of this invention is to provide a topical preparation dispenser-applicator with dual contact applicator surfaces comprising a ball applicator and a sponge applicator within the same apparatus, with a reservoir for storage of the topical preparation formed therebetween.

Another object of this invention is to provide an improved dispenser-applicator simple in construction, inexpensive to manufacture and efficient and effective in use and service.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims, with two specific embodiments as shown in the attached drawings. For the purpose of summarizing the invention, the dispenser-applicator of the invention comprises a ball applicator assembly, an oppositely-faced sponge applicator assembly, and a reservoir for storage of the topical preparation formed therebetween. The reservoir functions to supply the topical preparation to the ball applicator assembly to be dispensed onto the person's skin, whereupon the sponge applicator is used to more evenly spread the topical preparation over the person's skin. The reservoir may also function to supply the topical preparation to the sponge applicator for applying to the person's skin. During non-use, a ball applicator cap and a sponge applicator cap, protects the ball applicator and the sponge applicator, respectively.

In a hand-held embodiment of the invention, both of the caps are hand-grippable. Thus, during use of the ball applicator, the sponge applicator cap of the dispenser applicator is grasped in one hand and the ball applicator cap is removed with the other hand. The ball applicator is then used to dispense and at least partially spread the topical preparation onto the person's skin. The ball applicator cap is then put back over the ball applicator. By now grasping the ball applicator cap, the sponge applicator cap is removed, allowing the sponge to more evenly spread the topical preparation over the person's skin. Importantly, the caps protect the ball applicator and the sponge applicator from being contaminated by sand or the like, and prevent the topical preparation from getting on other objects during non-use.

In a handled embodiment of the invention, a telescopic handle assembly is rigidly connected to the reservoir for allowing the user to apply easily topical preparation in difficult to reach areas of the body. Similar to the hand-held embodiment, the caps can be separately removed so that, for example, when the ball applicator is being used, the sponge applicator is protected from contamination by its cap.

The dispenser-applicator of the invention is especially suitable for easily applying sun tan oils or lotions, or other liquid topical preparations to human skin. In addition, the present invention allows a simultaneous dispensing and application of topical preparations without the drawbacks of the prior art. Further, the invention makes available dual applicator surfaces in order to allow the user to apply a preparation by a roller ball applicator or by a sponge applicator. Moreover, the invention has a reservoir for the storage of the topical preparation formed between the ball applicator and the sponge applicator, hence eliminating the need to have a separate reservoir manufactured and attached to the dispenser-applicator.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
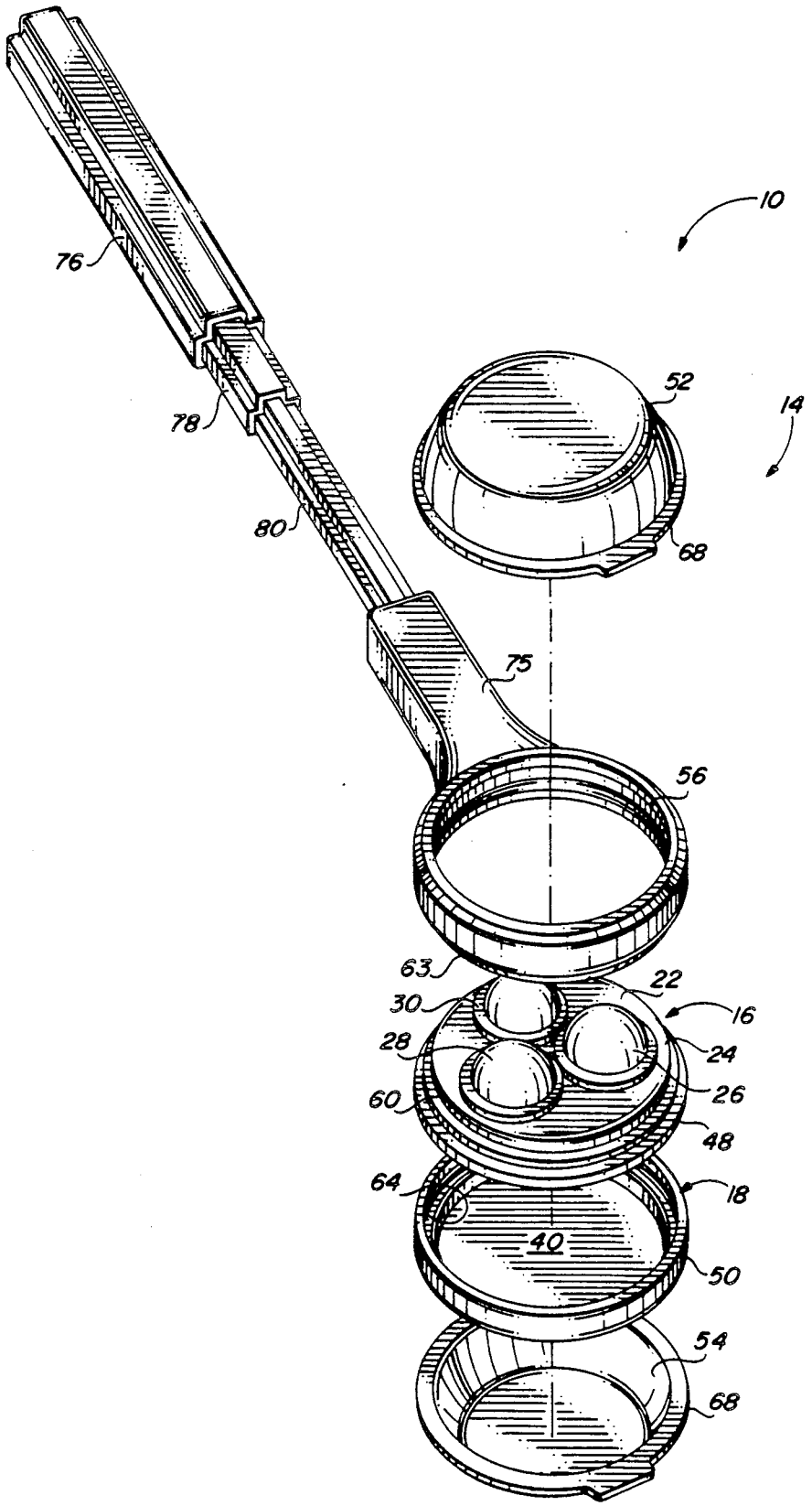
FIG. 1 is an exploded perspective view of the handled embodiment of the dispenser-applicator of the invention.
Figure 2:
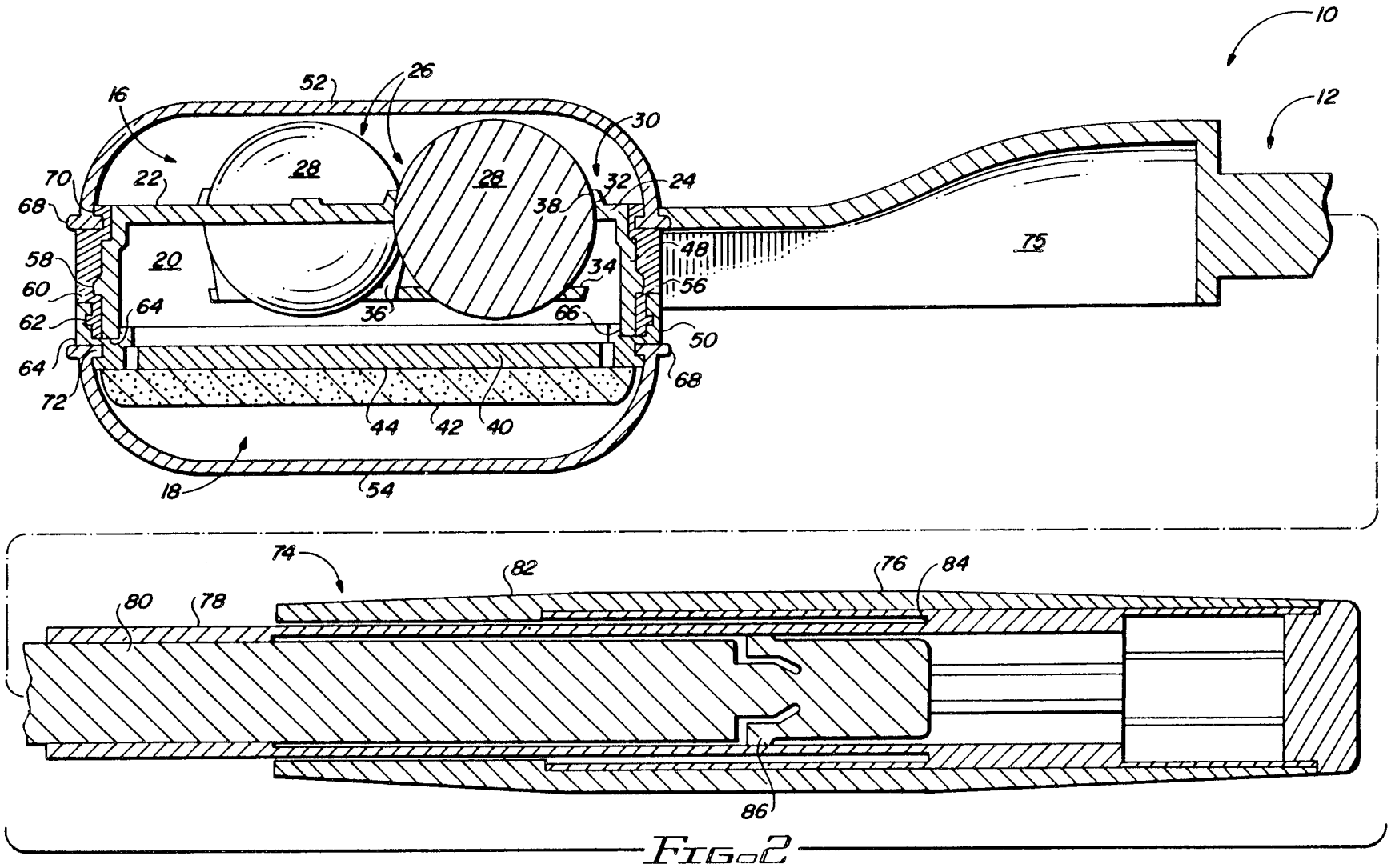
FIG. 2 is a longitudinal cross-sectional view of the handled embodiment of the dispenser-applicator of the invention.
Figure 3:
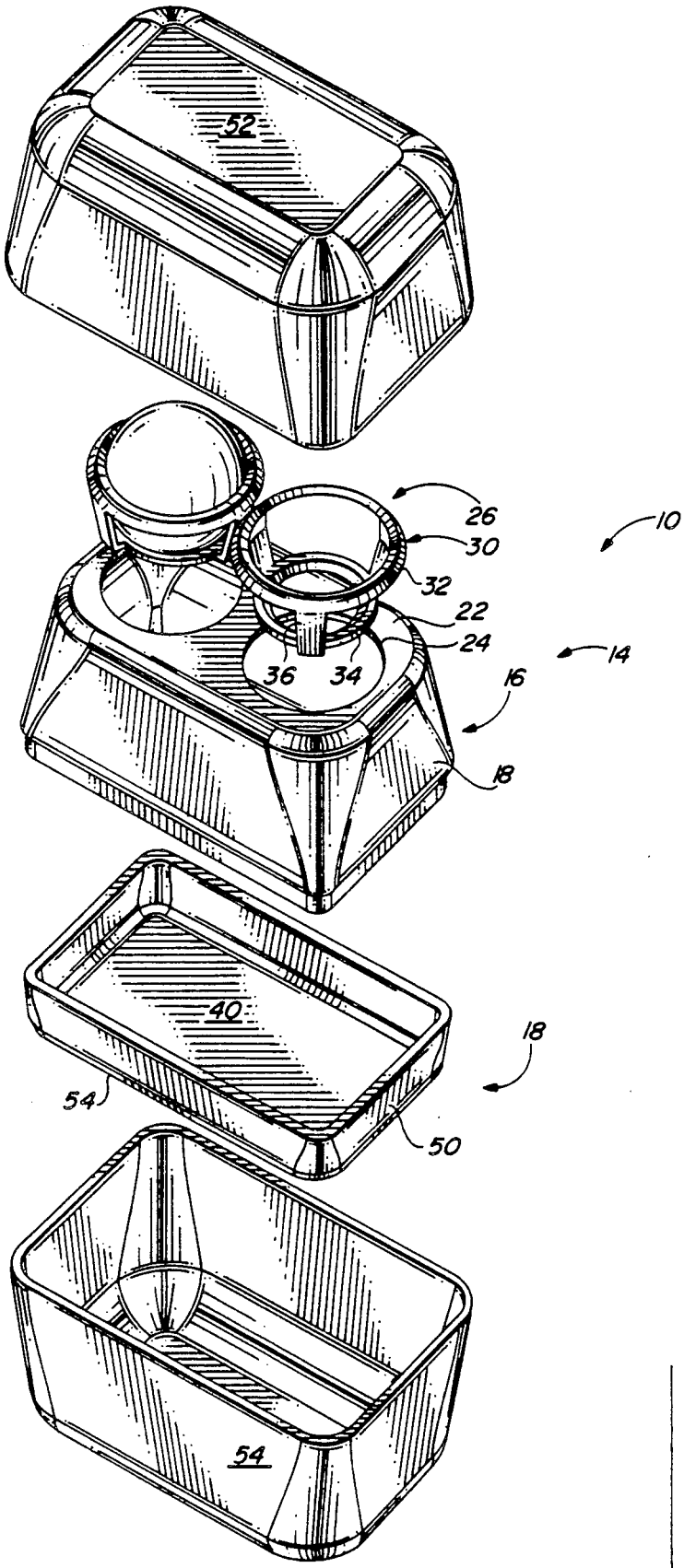
FIG. 3 is a exploded perspective view of the hand-held embodiment of the dispenser-applicator of the invention.
Figure 4:
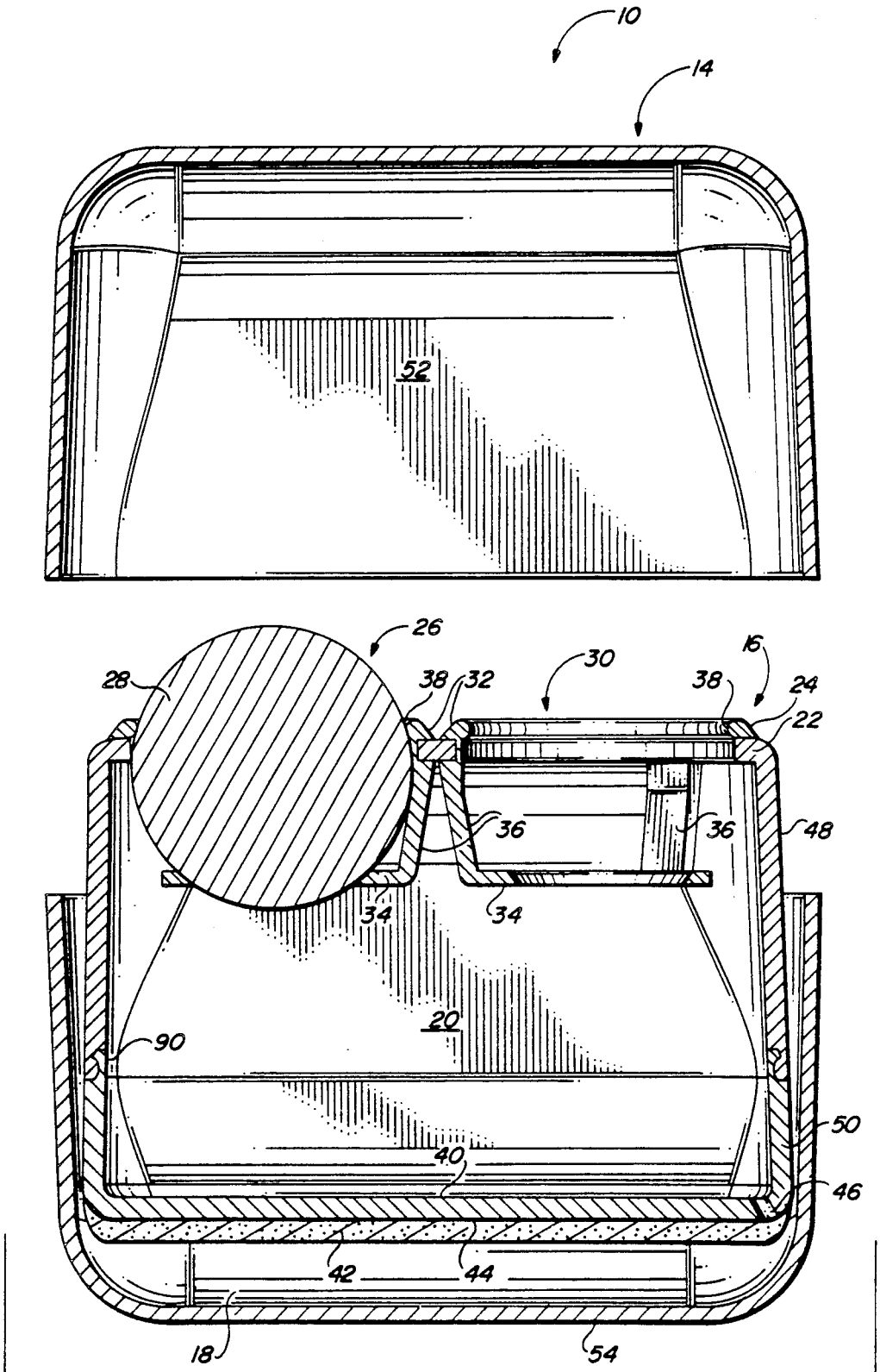
FIG. 4 is a longitudinal cross-sectional view of the hand-held embodiment of the dispenser-applicator of the invention.

The dispenser-applicator 10 of the invention comprises a handled embodiment 12 illustrated in FIGS. 1 and 2 and a hand-held embodiment 14 illustrated in FIGS. 3 and 4. In both embodiments 12 and 14, the dispenser-applicator 10 comprises a ball applicator assembly and a sponge applicator assembly, generally indicated by numerals 16 and 18, respectively. The ball and sponge applicator assemblies 16 and 18 are removably fastened together so as to form a sealed reservoir 20 therebetween. The reservoir 20 may be filled with a topical preparation to be dispensed by separating the sponge applicator assembly 18 from the ball applicator assembly 16 and pouring the topical preparation into the ball applicator assembly 16. The sponge applicator assembly 18 is then secured to the ball applicator assembly 16 to thereby form the sealed reservoir 20 therebetween.

In both embodiments, the ball applicator assembly 16 comprises a surface plate 22 having a plurality of apertures 24 for receiving a plurality of roller ball assemblies 26. Each roller ball assembly 26 comprises a spherical ball 28 positioned within a cage 30. The cage 30 comprises upper and lower rings 32 and 34 positioned in a spaced-apart relationship by interconnecting legs 36. The diameters of the rings 32 and 34 are appreciably less than the diameter of the spherical ball 28 and the length of the interconnecting legs 36 are dimensioned, such that the spherical ball 28 is retained within the cage 30 with the outer surface of the ball 28 sealing against the uppermost lip 38 of the upper ring 32. The upper and lower rings 32 and 34 and the interconnecting legs 36 are also preferably manufactured from a plastic material having sufficient resiliency such that when the spherical ball 28 is depressed, a gap is formed between its outer surface and the inner lip of the upper ring 32, thereby dispensing the topical preparation from the reservoir 20 through the gap.

Also in both embodiments, the sponge applicator assembly 18 comprises a generally flat surface plate 40 and an sponge 42 rigidly connected secured thereto, such as by adhesive 44. Sponge 42 preferably comprises an absorbent material, such as open-cell, highly resilient plastic. The surface plate 40 may be imperforate or may include one or more seepage holes 46. The diameter of the seepage holes 46 are preferably determined according to the viscosity of the topical preparation to be filled within reservoir 20 in such a manner that the absorbency of the sponge 42 causes seepage of the topical preparation through the holes 46 with sufficient seepage to wet the sponge 42 but without sufficient seepage to cause over saturation and hence dripping of the topical preparation from sponge 42.

Both of the surface plates 22 and 40 of the ball and sponge applicator assemblies 16 and 18 include a depending annular wall 48 and 50, respectively, which are sealingly secured together to define the reservoir 20 therebetween.

Finally, in both embodiments, a ball applicator cap, generally indicated by numeral 52, is provided for positioning over the ball applicator assembly 16 to protect and cover the ball applicator assembly during non-use. Similarly, a sponge applicator cap, generally indicated by numeral 54, is fitted over the sponge applicator assembly 18. Both caps 52 and 54 function to prevent contamination, such as sand, from contaminating the ball applicator assembly 16 and the sponge applicator assembly 18. The caps 52 and 54 also function to prevent any residual topical preparation that may exist on the ball 28 or the sponge 46 from being inadvertently applied to other objects, such as during storage of the dispenser-applicator 10.

Now referring specifically to FIGS. 1 and 2 which illustrate the handled embodiment 12 of the dispenser-applicator 10, the annular wall 48 of the ball applicator assembly 16 and the annular wall 50 of the sponge applicator assembly 18 are cylindrically shaped and are sealingly connected together by means of a threaded collar 56. The ball applicator assembly 16 is threadably connected to the threaded collar 56 by means of internal threads 58 positioned about the inner periphery of the threaded collar 56 which threadably (or snap in) engage external threads 60 positioned about the outer surface of the annular wall 48 of the ball applicator assembly 16 such that the ball applicator assembly 16 screws into the threaded collar 56 (see FIG. 1). Similarly, the sponge applicator assembly is threadably connected to the threaded collar 56 by means of external threads 62 positioned about the outer periphery of the threaded collar 56 which threadable engage internal threads 64 positioned on the inner periphery of the annular wall 50 of the sponge applicator assembly 18. Even though the annular walls 48 and 50 of the ball and sponge applicator assembly 16 and 18 are threadably interconnected by means of the threaded collar 56, the edge of the annular wall 48 of the ball applicator assembly 16 preferably seals directly to the inner surface of the surface plate 40 of the sponge applicator assembly 18 so as to define an annular seal 64. More preferably, a circular lip 66 is formed on the inner surface of the surface plate 40 so as to prevent inward flaring of the annular wall 48 when the ball and sponge applicator assemblies 16 and 18 are threadably secured together to form the annular seal 64.

The ball and sponge applicator caps 52 and 54 are preferably dome-shaped with an inwardly and outwardly protruding rim 68 formed about their peripheries. Cap grooves 70 and 72 are formed within the outer periphery of the threaded collar 56 and the annular wall 50 of the sponge applicator assembly 18 to removably receive the inwardly protruding portion of rim 68, thereby allowing the caps 52 and 54 to be installed over the ball and sponge applicator assemblies 16 and 18. The outwardly protruding portion of rim 68 permits resilient deformation of the caps 52 and 54 allowing removal of the caps 52 and 54 by disengagement of the rim 68 from the respective grooves 70 and 72.

A handle, generally indicated by numeral 74, is rigidly connected, preferably integrally formed, with the threaded collar 56 at yoke 75. Handle 74 is preferably telescopic, comprised by an outer tubular member 76 telescopically positioned over an inner tubular member 78 which is in turn telescopically positioned over the base member 80 of the handle 74. The outer and inner tubular members 76 and 78 preferably comprise mating stops 82 and 84, respectively, which engage each other when the tubular members 76 and 78 are telescoped to their extended positioned, such that further movement also telescopes the inner tubular member 78 relative to the center base member 80. The center base member 80 comprises a plurality of resilient fingers 86 which resiliently bear against the lumen of the inner tubular member 78 to prevent free telescopic motion. A stop 88 is provided on the lumen of the inner tubular member 78 which engages the resilient fingers 86 to limit the travel of the inner tubular member 78 relative to the center base member 80. As best shown in FIG. 1, preferably the tubular members 76 and 78 and the center base member 80 are noncircular in cross-section, such as in the form of a cross, so as to prevent rotational movement of the tubular members 76 and 78 relative to each other and relative to the center base member 80. Notably, configuring the tubular members 76, 78 and 80 into the form of a cross also defines four channels into which the resilient fingers ride during telescopic extension of the handle 74.

Now referring specifically to FIGS. 3 and 4 which illustrate the hand-held embodiment 14 of the dispenser-applicator 10, the annular wall 48 of the ball applicator assembly 16 and the annular wall 50 of the sponge applicator assembly 18 are rectangulary shaped and sealingly connected together at their peripheral edges by means of an interlocking snap fit 90. The ball applicator cap 52 and the sponge applicator cap 54 are rectangularly shaped and dimensioned to be frictionally retained over the ball applicator assembly 16 and the sponge applicator assembly 18, respectively, and to define a complete enclosure about the applicator assemblies 16 and 18. Both caps 52 and 54 are manufactured from a semi-rigid material, such as a plastic, that has sufficient resiligency to flex inwardly when tightly gripped so as to more frictionally retain the applicator assemblies 16 and 18.

During use, the sponge applicator cap 54 is tightly gripped to retain the applicator assemblies 16 and 18 therein while lightly gripping and removing the ball applicator cap 52. The ball applicator assembly 16 can be used to dispense and apply the topical preparation to the person's skin. After reinstalling the ball applicator cap 52, it can be tightly gripped to retain the applicator assemblies 16 and 18 therein while removing the sponge applicator cap 54. The sponge applicator assembly 18 can then be used to spread the topical preparation evenly over the person's skin.

Now that the invention has been described,

What is claimed is:

1. A dispenser-applicator for dispensing and applying a topical preparation to a surface, comprising in combination:

a ball applicator assembly including a surface plate having at least one roller ball assembly and including a depending annular wall, said roller ball assembly comprising a spherical ball positioned within a resilient cage, said cage comprising an upper ring and means for urging an outer surface of said ball sealingly against a lip of said upper ring such that upon depressing said ball, a gap is formed between said lip and said ball to allow dispensing of the topical preparation from said reservoir;

a sponge applicator assembly including a sponge and a depending annular wall;

means for removably fastening said annular wall of said ball applicator assembly and said annular wall of said sponge applicator assembly relative to each other to form a sealed reservoir therebetween;

a ball applicator cap and means for removably positioning said ball applicator cap over said ball applicator assembly; and a sponge applicator cap and means for removably positioning said sponge applicator cap over said sponge applicator assembly;

means for providing fluid communication between fluid in the reservoir and at least one of the fluid applying surfaces of the balls of the ball applicator assembly and the sponge of the sponge applicator assembly;

an elongated handle having a first end adapted to be held by a user and a second end adapted to be removably coupled to one of the applicator assemblies so as to preclude concurrent rotation of the two applicator assemblies with respect to the handle;

whereby, said reservoir may be filled with the topical preparation to be dispensed by separating said applicator assemblies and pouring the topical preparation into one and then after closure of said applicator assemblies, said ball applicator assembly may be used to dispense the topical preparation to the surface and said sponge applicator assembly may be used to apply the topical preparation to the surface.

2. A dispenser-applicator for dispensing and applying a topical preparation to a surface, comprising in combination:

a ball applicator assembly including a surface plate having at least one roller ball assembly and including a depending annular wall, said roller ball assembly comprising a spherical ball positioned within a resilient cage, said cage comprising an upper ring and means for urging an outer surface of said ball sealingly against a lip of said upper ring and such that upon depressing said ball, a gap is formed between said lip and said ball to allow dispensing of the topical preparation from said reservoir;

a ball applicator cap and means for removable positioning said ball applicator cap over said ball applicator assembly;

a sponge applicator assembly including a surface plate having a sponge rigidly connected thereto and including a depending annular wall, said surface plate of said sponge applicator assembly comprising at least one seepage hole to allow dispensing of the topical preparation from said reservoir;

a sponge applicator cap and means for removably positioning said sponge applicator cap over said sponge applicator assembly;

means for removably fastening said annular wall of said ball applicator assembly and said annular wall of said sponge applicator assembly relative to each other to form a sealed reservoir therebetween, whereby, said reservoir may be filled with the topical preparation to be dispensed by separating said applicator assemblies and pouring the topical preparation into one and then after closure of said applicator assemblies, said ball applicator assembly may be used to dispense the topical preparation to the surface and said sponge applicator assembly may be used to apply the topical preparation to the surface.

* * * * *